United States Patent [19]

Speraggi

[11] Patent Number: 4,504,162

[45] Date of Patent: Mar. 12, 1985

[54] SERIAL PRINTER PROVIDED WITH CUTTER

[75] Inventor: Marcello Speraggi, Milan, Italy

[73] Assignee: Honeywell Information Systems Italia, Milan, Italy

[21] Appl. No.: 608,921

[22] Filed: May 10, 1984

Related U.S. Application Data

[63] Continuation of Ser. No. 526,215, Aug. 24, 1983, abandoned, which is a continuation of Ser. No. 350,538, Feb. 19, 1982, abandoned.

[30] Foreign Application Priority Data

Feb. 24, 1981 [IT] Italy ..... 19936 A/81

[51] Int. Cl.[3] ..... B41J 11/70

[52] U.S. Cl. ..... 400/621; 400/656

[58] Field of Search ..... 400/621, 654, 656

[56] References Cited

U.S. PATENT DOCUMENTS

| | | | |
|---|---|---|---|
| 1,362,544 | 12/1920 | Smith | 400/621 |
| 1,615,598 | 1/1927 | Smith | 400/621 |
| 1,643,583 | 9/1927 | Norin | 400/621 |
| 1,960,175 | 5/1934 | Stevens | 400/621 |
| 3,951,252 | 4/1976 | Selke et al. | 400/621 |
| 4,165,188 | 8/1979 | Rempel | 400/248 X |
| 4,234,261 | 11/1980 | Hendrischk | 400/621 |

FOREIGN PATENT DOCUMENTS

| | | | |
|---|---|---|---|
| 2516476 | 10/1976 | Fed. Rep. of Germany | 400/621 |
| 2655832 | 6/1978 | Fed. Rep. of Germany | 400/621 |
| 133982 | 10/1980 | Japan | 400/689 |

*Primary Examiner*—Edgar S. Burr
*Assistant Examiner*—Charles A. Pearson
*Attorney, Agent, or Firm*—George Grayson; Nicholas Prasinos

[57] ABSTRACT

Serial printer provided with cutter, the printer being of the type in which printing is performed by a printing head mounted on a carriage sliding on guides parallel to the printing line and a continuous printing support moves perpendicularly to the direction of such guides leaning against a substantially vertical platen. A rotating cutter is lever-mounted on the carriage over the printing head in a position very close to the printing line and it can be actuated in order to partially overlap a cutting edge of the platen, the edge being parallel to the printing line.

Owing to the printing head movement along the printing line, the rotating cutter when actuated operates the transversal cutting of the continuous form. The cut form is disposed in a collecting drawer behind the platen owing to the movement imposed by the rotating cutter and to the reduced thickness of the platen which constitutes a drawer wall. A transparent elastic leaf coupled to the lever on which the rotating cutter is mounted assures the form steadiness during the cutting by pressing it against the platen near the cutting zone. It further provides an elastic reaction which brings the rotating cutter in rest position when it is not actuated to be in cutting position. The leaf does not hamper print visibility nor does it hamper the loading of the form in the printer when the carriage is at its end of travel position.

4 Claims, 5 Drawing Figures

SERIAL PRINTER PROVIDED WITH CUTTER

This application is a continuation of application Ser. No. 526,215, filed Aug. 24, 1983 which is a continuation of Ser. No. 350,538 filed Feb. 19, 1982, both abandoned.

BACKGROUND OF THE INVENTION

1. Field of the Invention

The present invention relates to a serial printer provided with a cutter for the cutting of a continuous form into several individual sheets.

2. Description of the Prior Art

It is known that continuous forms are generally used in high speed printers for data processing systems to avoid the problems and inconvenience connected with the loading and the feeding of single sheets. The forms commonly used consist of a continuous paper web rolled on a feeding drum, or in a continuous paper web provided with side perforations intended for the form feeding; they are fan folded at regular intervals to form a pile. By the use of continuous forms, the inconvenience of time wasted in the manual loading of separated sheets is avoided. Moreover, separate mechanical equipment for picking up and feeding single sheets in sequence is not required.

Once printing has been performed, sheets from the continuous forms are separated by manual tearing of the continuous form. This is performed with the aid of rulers arranged on the printing equipment transversely to the form. In continuous forms having side perforations, such a separating operation is made easier by partial cuts arranged in correspondence to the foldings. It is therefore clear that with this kind of equipment the manual operation inconveniences are avoided only in part. Even if the manual operation consists only in tearing the form, there is still a waste of time. Moreover, the torn edge quality is poor and unacceptable for several types of documents. In addition, the tearing zone must be quite far from and downstream the printing line. This prevents the printing on a broad zone of the continuous form between the tearing line and the printing line, unless the tearing operation is preceded by the printing of such zone (i.e. by the printing, at least in part, of the next single form). This wastes a great quantity of paper.

Recently, to avoid such inconveniences, serial printers equipped with cutters have been put on the market. In some models, the cutter consists of a pair of shears associated with paper locking devices and controlled by suitable levers. Such a solution assures a good cutting quality but avoids only in part the other disadvantages. In other printers, particularly of the serial type, a cutting roll has been mounted on the printing carriage or on an additional carriage sliding in parallel to the previous one. The cutter must be kept away from a fixed countercutter, transversal to the printing form and parallel to the printing line, by means of a suitable command. In this type of printer, the carriage movement is used to move the cutting roll and to perform the cutting of the continuous form. Examples of printers provided with cutting rolls are described in U.S. Pat. No. 4,234,261 issued on Nov. 18, 1980 and in French patent application No. 2,307,658 published Dec. 8, 1978. Such printers provide for a good cutting quality but they cause other problems in the loading of the continuous form due to the presence in the printer of a form pressing rule extending along the whole cutting line; the need of multiple form feeding equipments, one permanently engaged with the continuous form and the other one for moving and positioning the sheet cut from the form; structural problems which hamper visibility of the printing support; and fabrication complications in urging the continuous forms against the counter cutter during the cutting operation.

OBJECTS OF THE INVENTION

It is an object of the invention to provide an improved serial printer.

It is another object of the invention to provide an improved cutter for a serial printer.

These and other objects of the invention will become obvious upon a reading of the specification together with the drawings.

SUMMARY OF THE INVENTION

The present invention overcomes many of the problems mentioned supra and provides a cutter in a serial printer which automatically operates the cutting of the continuous form very close to the printing line. This is accomplished by the use of a cutting roll cutter, mounted on the printing carriage of the serial printer, which is positioned in a rest position or in a work position by means of an actuator, preferably an electromagnetic device. The cutting roll is lever-mounted over the printing head, immediately downstream on the printing line, having for reference the feeding direction of the form. The cutting roll cooperates with a sharp edge of the platen to form with it a shear comprising a fixed counter cutter and a rotating cutter shiftable along the fixed countercutter. The continuous form is locally urged and held against the platen by an elastic transparent leaf which does not hamper the visibility of the printing support and the loading of the continuous form in the printer (when the carriage is brought in travel end position). The elastic leaf also acts as return element for urging the cutting roll in rest position. The setting of the cutter is obtained by a minimum of elements additional to the basic structure of a serial printer and it is therefore particularly inexpensive. In addition, because of the use of the platen as a countercutter, the cutting may be performed very close to the printing line. It is also clear that the cutting quality is excellent and the cutting is not conditioned to fixed positions of the continuous printing form. Thus a printer equipped with the cutting device object of the invention can be used for several needs such as cutting of address labels, newspapers bands, tickets, single sheets of any desired height and so on. Finally, the position of the rotating cutter over the printing head combined with a substantially vertical downward feeding of the continuous form toward the printing and cutting zone allows the right positioning of the cut to form paper piles within a collecting drawer without the need of using complex feeding and collecting devices. Such correct positioning is secured by the particular configuration of the platen which has a reduced thickness and practically constitutes a side of the collecting drawer.

DETAILED DESCRIPTION OF THE PREFERRED EMBODIMENTS

Figure 1:
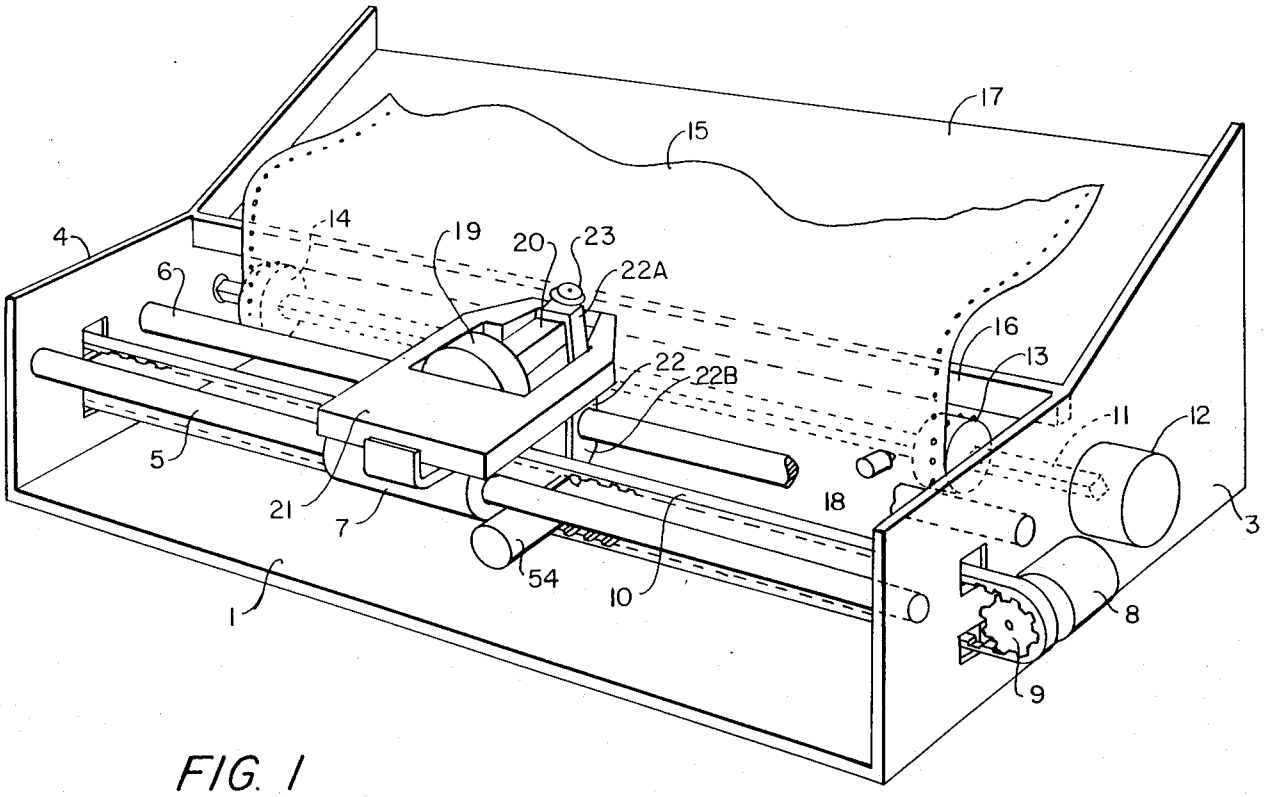
FIG. 1 is the perspective view of a serial printer equipped with a cutter according to the present invention.

With reference to FIG. 1, the printer comprises a frame having a bottom plate 1 and two side plates 3 and 4. Two parallel guiding bars 5 and 6 are mounted between the side plates. A printing carriage 7 is slidably mounted on the guiding bars by means of guiding bushes. The printing carriage can move axially along the whole length of the guiding bars. The carriage movement is controlled by a motor 8, preferably a step motor through a toothed wheel 9 keyed to the motor shaft, and a toothed belt 10 fixed to a carriage 7. A rectangular cross-sectioned bar 11 is located parallel to guiding bars 5 and 6. Bar 11 is hinged on the side plates 3 and 4 which are perpendicular to the guiding bars 5 and 6. The rotation of bar 11 is controlled by a motor 12, preferably a step motor too. Two feeding sprocket wheels 13 and 14 are slidably mounted on bar 11, the pins of such wheels have the function of engaging with the side perforations of the continuous printing form. For sake of clarity, only the essential structure of the sprocket wheels is shown. It is, however, clear that they are provided with pressure pads and axial locking devices as known to people skilled in the art.

An alternative is to replace the sprocket wheels by tractors of the kind disclosed in U.S. Pat. No. 4,160,606 or by a friction feeding roll coupled to pressure rollers where the printer is of the type without side perforations.

The continuous printing form 15 is fed by toothed wheels 13 and 14 towards a platen 16 consisting of a rigid bar, with L section, arranged parallel to the guiding bars of the carriage and fixed between the two side plates 3 and 4. The continuous printing form 15 leans on platen 16 in a substantially vertical position and, owing to its weight, leads it to a collecting drawer 17 arranged behind the platen. An optical magnetic or electrical sensor, shown as block 18, is preferably coupled to one of the feeding wheels to identify some marks formed by printing (magnetic or conductive) or by additional perforations arranged along the continuous form edge.

The function of such sensor is to identify predetermined positions of the printing form when the form is fed by motor 12, and to signal this event to the electronic control equipments of the printer. A printing head 19 of the needle type is mounted on the printing carriage. With the carriage movement, the nose 20 of the head is in close proximity to the platen 16 on which the continuous printing form is lying. An ink-ribbon cartridge 21, such as the one described in British Pat. No. 1,502,760, is inserted in suitable clutches of the carriage. It interposes a portion of the ink-ribbon between the printing head nose 20 and the printing support. The ink-ribbon cartridge is formed by an ink-ribbon housing and two arms extending from the housing and forming with it a recess where the print head is partially located.

Up to now it should be noted that the structure of the described printer does not differ from the one of similar printers known in the art. However, according to the invention, a fork lever 22 is coupled to the carriage hinged on guiding bar 6. The upper portion 22A of lever 22 is rider like placed over the print head nose in the recess formed by the ink-ribbon cartridge arms. A sharp edge roll 23 is hinged on the upper portion 22A. The roll forms a rotating cutter placed on a substantially horizontal plane. The lower portion 22B of lever 22 is coupled to the plunger of an electromagnet 54 mounted in the lower part of the carriage. When the electromagnet is deenergized and lever 22 is in rest position, cutting roll 23 is apart from the platen 16 and does not interfere with the printing support. When the electromagnet is energized, lever 22 is slightly rotated around guide bar 6 and the cutting roll partially lies down on the upper edge of the platen 16 thus forming with it a shear having a rotating cutter and countercutter bar. In its movement from one end to the other end of the guiding bars, the carriage moves the rotating cutter along the upper edge of the platen 16 and causes the cutting of the printing support interposed between rotating cutter and platen.

Figure 2:
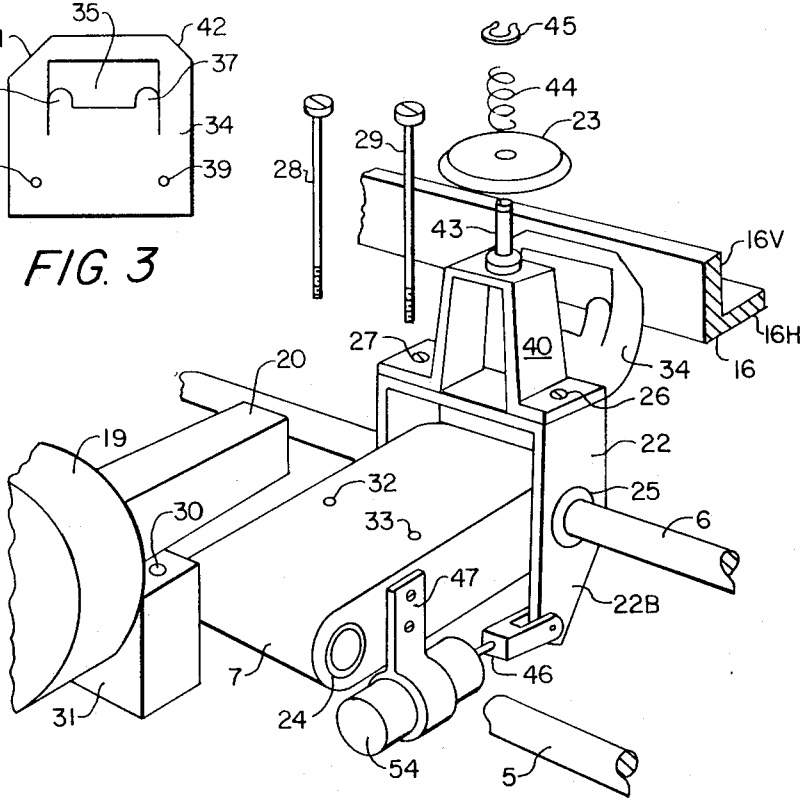
FIG. 2 is the exploded perspective view of some elements of the serial printer of FIG. 1.

The details of the shear are shown, for better understanding, in the perspective exploded view of FIG. 2. The carriage is provided with guiding bushings 24 and 25 which are coupled and slide over the guiding bars 5 and 6. Referring to FIG. 2 only a portion of the guiding bars is shown. Bushing 25 protrudes from the carriage body and provides a shoulder on which fork lever 22 is hinged through a corresponding opening. A turrent 40, preferably made as a separate portion, is fixed on the upper portion of the fork by two screws 26 and 27. The turret is in the form of a C shaped element having two externally folded wings. The turret forms a recess intended to freely house the nose 20 of the printing head.

In FIG. 2, the head is away from its normal position for sake of clarity. The printing head 19 is fixed to the printing carriage by two screws 28 and 29, inserted in two openings (one of which, identified by reference numeral 30, is visible in FIG. 2) of a print head supporting base 31 and screwed in two threaded seats 32 and 33 of the printing carriage. A transparent elastic leaf 34, preferably made in polyester, is partially interposed between the wings of the turret and the upper portion of fork lever 22. Leaf 34 bends over and leans against the platen. In case a printing support is present on the platen, the leaf urges it against the platen. A preferred form for leaf 34 is shown in FIG. 3.

Figure 3:
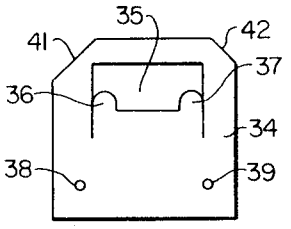
FIG. 3 is a front view of an element of the cutter shown in FIG. 2.

Referring to FIG. 3, leaf 34 is substantially rectangular in shape. A rectangular window 35 is formed in the leaf. Two small fingers 36 and 37 extend internally to the window 35 close to its sides. Two openings 38 and 39 enable the leaf 34 to be fixed and positioned by means of screws 26 and 27 between turret 40 and the upper portion of fork lever 22. Window 35 enables the action of the printing elements (in the described embodiment, the printing needles) on the printing support through the sole interposition of the ink-ribbon. The function of leaf 34 is twofold: first it provides the firm urging of the printing support against the platen in close proximity to the zone where the cutting operation and the printing operation occur; second, owing to the resilient reaction it normally keeps the turret 40 away from the platen. The first function has the additional effect of substantially reducing the printing support vibration caused by the printing operation and the consequent noise. The leaf angles 41 and 42 which come in contact with the printing support are beveled, in order to bring down possible dog ears present on the edges of the printing support without causing tearing or clogging. Internal fingers 36 and 37 are rounded off for the same reason. A pin 43 is fixed on turret 40. The cutting roll 23 is pivoted on such pin. The cutting roll is allowed a certain degree of axial freedom and is normally held in contact with turret 40 by means of a biasing compression spring 44 inserted on pin 43 and kept thereon by a retaining ring 45. The lower portion 22A of lever 22 is mechanically coupled to the actuator arm 46 of an electromagnet 54 which is mounted by means of a suitable flask 47 on the lower side of printing carriage 7.

Referring again to FIG. 2 there is clearly shown, in section, the shape of platen 16. It consists of a prismatic bar having an L shaped section. The vertical wing 16V of the bar having a reduced thickness in the order of few millimeters forms with its external surface the platen, and the horizontal wing 16H provides the required transverse stiffness to the element. The upper edge of the vertical wing is cut in a sharp edge, relative to the platen surface and cooperates with the sharp edge of the cutting roll 23 to form with it a cutting roll shear.

Figure 4:
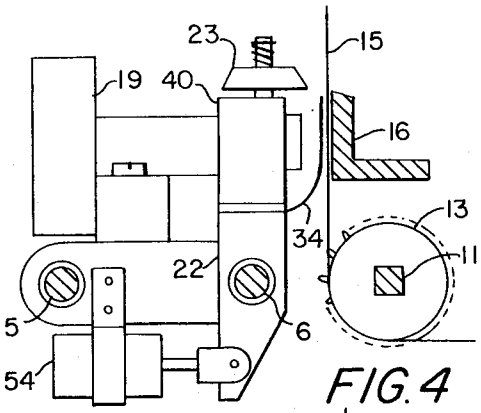
FIG. 4 is a side view of the cutter shown in FIG. 2, in rest position.
Figure 5:
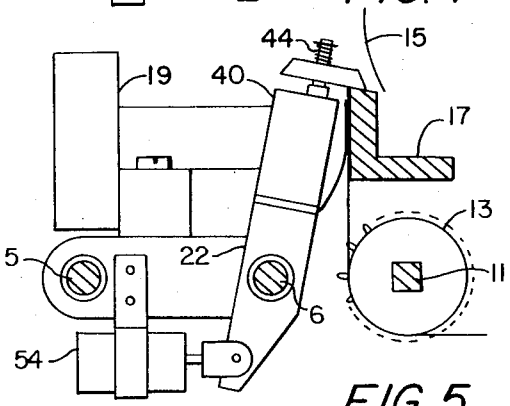
FIG. 5 is a side view of the cutter shown in FIG. 2, in working position.

Referring now to FIGS. 4 and 5, there is shown in side view the operation of the shear. In FIG. 4, the shear is shown in rest position. Turret 40 is maintained apart from the platen 16 by the resilient reaction exerted by leaf 34 and consequently rotating cutter 23 is held adequately apart from platen 16. The printing support 15, fed by the sprocket wheels, may freely advance in vertical direction without interfering with cutting roll 23. Likewise, the printing carriage and its various elements may slide along the guiding bars 5 and 6 without interfering with the printing support.

In FIG. 5, the shear is shown in working position. By energizing the electromagnet 54, the lower portion of fork lever 22 is pulled towards the electromagnet and turret 40 is projected towards the platen. Consequently, the cutting roll 23, on its sharp edge, partially overlaps with the platen edge and causes the cutting of the possible interposed printing support. By moving the printing carriage along the guiding bars, the cutting roll 23 slides against the sharp edge of the platen for its whole length and causes the transversal cutting of the possible interposed printing support. The local pressure exerted by leaf 34 prevents possible movement of the printing support during the cutting. In addition, the cutting roll during its cutting action urges the edge of the cut form towards the collecting drawer 17 where the cut portion of the printing support drops down, owing to its own weight, without need for any particularly auxiliary element for this purpose. Accordingly, printed side is clearly visible.

It is therefore evident that the described shear provides the following advantages:

(1) a cut of excellent quality;

(2) a cut performed in close proximity to the printing line: the printing support may be printed immediately below the cutting line and paper waste is provided;

(3) the cutting may be performed at any desired transversal position of the printing support and there is no need to perform the cutting in preestablished precut positions of the printing support;

(4) the cutting is performed by adding few and inexpensive elements to the conventional structure of a serial printer, and without requiring any additional feeding device for the cut forms;

(5) the cutting may be automatically performed on command by keyboard or central processing unit, through the use of movements intrinsic to the operation of a serial printer and consequently;

(6) the cutting operation may be performed at high speed and deadtimes implied in manual operations are avoided;

(7) the printing support is clearly readable both during printing as well as during the cutting operation and further when it drops into the collecting drawer.

In addition to the mentioned advantages, there is also a remarkable reduction of the noise, caused by vibrations of the printing support during printing, owing to the use of leaf 34 with the twofold function of a return element for the cutting roll and of a pressure element for the printing support.

It is clear that the preceding description relates to a preferred embodiment of the invention and that several changes can be made to the described embodiment without departing from the scope of the invention. In particular, the described embodiment is characterized by several features of the dot matrix printing head and by the use of ink-ribbon cartridges mounted on the printing carriage. It is clear that if printing heads of different kind are used such as for instance daisy printing heads, or if the printers make use of an ink-ribbon located along the whole printing line length, the mechanical arrangement which couples the cutting roll to the printing carriage may be widely modified to match the structural requirements of such kind of printers. The platen may further consist in a solid prismatic bar, provided that the upper face intended to cooperate with the cutting roll is provided with a chamfer, thus leaving a thickness of the countercutter in the same order as the overlap occurring between cutting roll and countercutter, so as to assure the correct disposition of the cut form in the collecting drawer.

What is claimed is:

1. A serial printer provided with cutter, where printing is performed by a printing head mounted on a carriage sliding on guide bars parallel to the printing line and a continuous printing support is fed transversely to the direction of the printing line and leans on a substantially vertical platen, said platen having a sharp edge above the printing line and parallel to the direction of the printing line, such serial printer comprising:

(a) a lever mounted on said carriage and pivotable about one of said guide bars, (b) a spring-loaded cutting roll mounted on said lever so as to be located over and close to said printing head, downstream of the printing line, said cutting roll having a substantially vertical axis of rotation (c) an elastic leaf fixed to said lever, said leaf bearing against said platen so as to maintain said lever in a rest position where said cutting roll is apart from said platen, (d) actuating means rocking said lever to bring said cutting roll in a cutting position where said cutting roll partially overlaps said sharp edge of said platen, said elastic leaf having a reduced width as compared to the length of the printing line and exerting a local pressure on the continuous printing support slightly below the cutting roll.

2. A serial printer as recited in claim 1, wherein said platen comprises a prismatic bar having a vertical wing with a thickness on the order of a few millimeters and a horizontal stiffening wing.

3. A serial printer as recited in claim 1 wherein said printing carriage is provided with a bushing coupling with one of said guide bars, said bushing providing a pivot for said lever.

4. A serial printer as claimed in claim 3 comprising further a collecting drawer for collection of the forms cut from said continuous printing support, said drawer being located on the rear of said platen, one side of said drawer being formed by a vertical wing of said platen.

* * * * *